US005581927A

United States Patent [19]

Meller

[11] Patent Number: 5,581,927

[45] Date of Patent: Dec. 10, 1996

[54] FIREARM WITH SAFETY DEVICE

[75] Inventor: Yehuda Meller, Holon, Israel

[73] Assignees: Binjamin Yirmiyahu, Bnei-Brak; Mordechai Yirmiyahu, Givatayim, both of Israel

[21] Appl. No.: 372,761

[22] Filed: Jan. 13, 1995

[30] Foreign Application Priority Data

Jan. 20, 1994 [IL] Israel ..... 108381

[51] Int. Cl.[6] ..... F41A 17/02

[52] U.S. Cl. ..... 42/70.11; 42/70.02

[58] Field of Search ..... 42/70.01, 70.02, 42/70.11

[56] References Cited

U.S. PATENT DOCUMENTS

| | | | |
|---|---|---|---|
| 774,712 | 11/1904 | Vold | 42/70.11 |
| 2,945,316 | 7/1960 | Mulno | 42/70.11 |
| 3,673,725 | 7/1972 | Cravener | 42/70.11 |
| 4,261,127 | 4/1981 | Karkkainen | 42/70.11 |
| 4,532,729 | 8/1985 | Von Muller | 42/70.11 |
| 5,235,763 | 8/1993 | Nosler et al. | 42/70.11 |

FOREIGN PATENT DOCUMENTS

| | | | |
|---|---|---|---|
| 3120 | 9/1982 | WIPO | 42/70.11 |
| 14146 | 9/1991 | WIPO | 42/70.02 |

*Primary Examiner*—Stephen C. Bentley
*Attorney, Agent, or Firm*—Ladas & Parry

[57] ABSTRACT

A firearm includes a locking device for receiving a removable key, and a latch element movable by an inserted key either to a locking position or to a releasing position. The locking device is located such that the latch element, when in the locking position, interferes with the operation of an essential operative component of the firearm to disable the firearm from firing a cartridge, and when in the releasing position permits the essential operative component to operate properly and thereby to enable the firearm to be used for firing a cartridge.

19 Claims, 6 Drawing Sheets

FIREARM WITH SAFETY DEVICE

FIELD AND BACKGROUND OF THE INVENTION

The present invention relates to firearms, and particularly to a firearm equipped with a safety device which may be used for disabling the firearm from firing a cartridge.

Firearms are presently widely available among civilians as well as law enforcement agents and military personnel. They therefore represent a serious danger to children and others who may have unauthorized access to the firearm. A common way to prevent accidental firing of a firearm is to remove from it an essential operative component, such as the magazine of a pistol, and to keep it separate from the firearm itself. However, in such case the firearm is not ready for use should a need suddenly arise; morever, the separated component may get lost or misplaced. Another known safety means for disabling a firearm from firing a cartridge is an add-on locking device mounted on the trigger guard to prevent access to the trigger. However, in order to enable the firearm for use, the add-on device must be physically removed and placed at a suitable location for ready re-use whenever necessary, which is not only time-consuming and inconvenient, but may also result in the misplacement or loss of the removed device.

Other techniques for disabling a firearm include the insertion of an insert into a firearm's firing chamber or magazine chamber which insert must be withdrawn to enable the firearm to be used. However, an insert into the firing chamber may damage the rifling of the firing chamber. Moreover, such inserts must be separately stored and/or carried by the user, which is not always convenient, and which can also result in the loss or misplacement of the insert.

OBJECTS AND BRIEF SUMMARY OF THE INVENTION

An object of the present invention is to provide a firearm with a safety device having advantages in the above respects. Another object of the invention is to provide a safety device for a firearm which can be applied to many diverse types of firearms. A further object of the invention is to provide a safety device which can be applied to existing firearms with a minimum change in the firearm itself.

According to a broad aspect of the present invention, there is provided, in a firearm including a plurality of essential operative components the absence or malfunction of any of which renders the firearm inoperative to fire a cartridge, a locking device for receiving a removable key insertable into the locking device, and a latch element movable by an inserted key either to a locking position or to a releasing position. The locking device includes a cylindrical housing closed at its opposite ends by end walls. The length of the housing is substantially shorter than the transverse dimensions of its end walls, thereby providing a relatively flat, compact construction. One of the end walls is formed with a keyhole for receiving the removable key, and the opposite end wall is formed with an opening through the latch element projects when moved by the inserted key to its locking position. The locking device includes attaching means for attaching the housing to the firearm such that the latch element, when in the locking position, interferes with the operation of one of the essential operative components to disable the firearm from firing a cartridge, and when in the releasing position permits the essential operative component to operate properly and thereby to enable the firearm to be used for firing a cartridge.

The expression "essential operative component" as used herein refers to any component of the firearm, including its ammunition-holding means, the absence or malfunction of which renders the firearm inoperative to fire a cartridge.

According to further features in the preferred embodiments of the invention described below, the housing further includes a rotatable actuator having a finger engageable with the latch element. The actuator is rotatable by the insertion and rotation of a key via the keyhole to rotate the finger to move the latch element to its locking position by projecting the latch element through the opening in the housing, or to its releasing position retracting the latch element within the housing.

It will thus be seen that a firearm constructed in accordance with the foregoing features does not require any add-on locking device or insert which has to be separately removed and stored in order to enable the firearm; but rather requires merely a key, which can be conveniently carried by the user with the many other keys the user normally carries. Thus, the firearm may be stored in its disabled condition and quickly enabled whenever necessary by an authorized person by merely inserting and rotating the key. Such a key would generally be carried by the user with the user's other keys, thereby adding no significant burden to the authorized user, and also decreasing the possibility of losing or misplacing the key, as compared to where an add-on locking device or an insert is needed for disabling the firearm.

As will be described more particularly below, such a locking device may be applied in a very simple manner to a wide variety of different types of firearms. For purposes of example, a number of different types of firearms are described below showing how each may accommodate the locking device in order to disable the firearm from being used for firing a cartridge.

Further features and advantages of the invention will be apparent from the description below.

DESCRIPTION OF THE DRAWINGS

The invention will now be described, by way of example only, with reference to the accompanying drawings wherein.

DESCRIPTION OF SPECIFIC EMBODIMENTS

Figure 1:
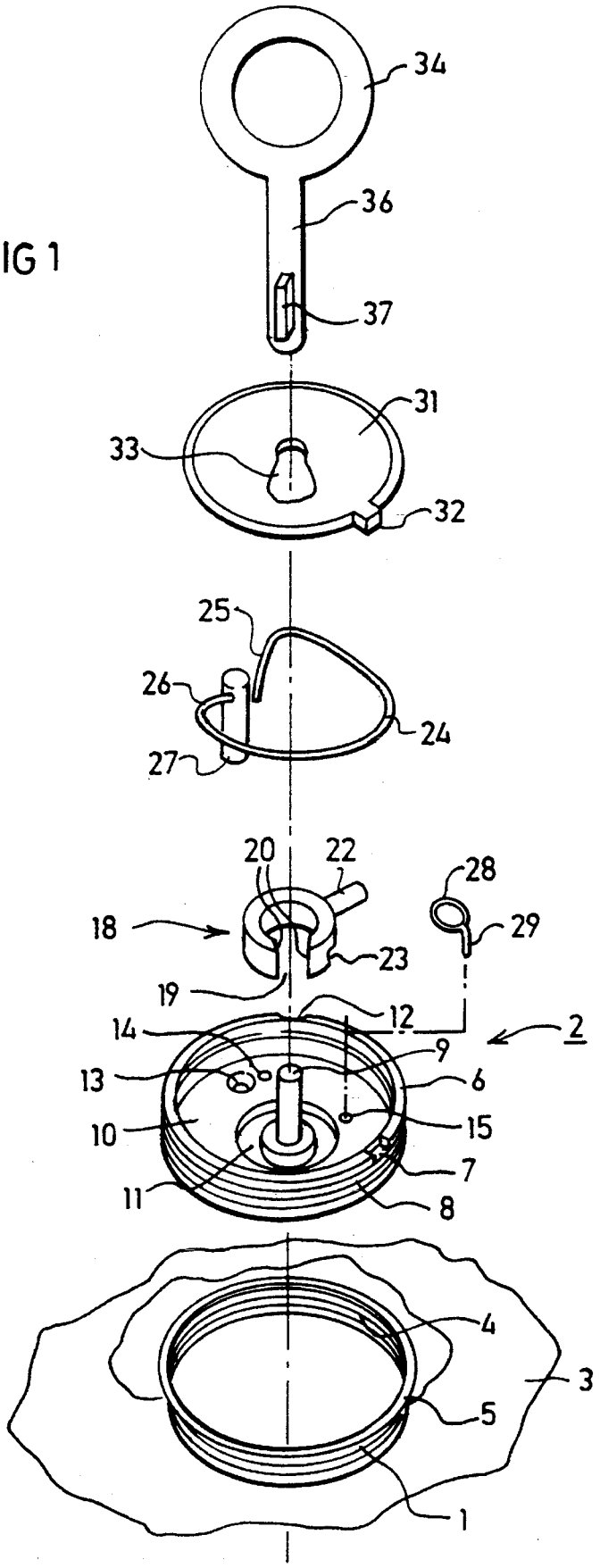
FIG. 1 is an exploded perspective view of one form of lock constructed in accordance with the present invention.

Reference is first made to FIGS. 1–4 of the drawings for a description of the structure and operation of a lock constructed according to the present invention. The lock, generally designated 2, fits into a cylindrical cavity in the form of a sleeve 1 securely held by a structural part 3 of the firearm, such as the sidewall of a pistol grip. Sleeve 1 is formed with internal threads 4 and a projecting rim 5. Lock 2 comprises a cylindrical housing 6 formed with external threads 8 enabling it to be threaded into sleeve 1. Housing 6 is formed at its upper edge with a rectangular cutout 7, and with a notch 12 receiving a pin (not shown) for retaining the housing in place.

Housing 6 is closed at one end by an end wall 10 which is integrally formed with a central stem 9 projecting from its center, and with a concentric annular groove 11 around the stem. End wall 10 is further formed with a first cylindrical bore 13 and two smaller bores 14 and 15. A horseshoe-shaped actuator 18, formed with a slot 19 between cheeks 20, is rotatably mounted with the annular groove 11. Actuator 18 has a laterally projecting finger 22 and an indentation 23 on its outer face.

Within the housing 6 there is located a single turn helical spring 24 having a first, vertical end portion 25 received in bore 14, and a second, horizontal end portion 26 received in a hole of a cylindrical latch element 27 reciprocable within bore 13.

A looped retainer spring 28, having a shank 29 received within bore 15, is designed to retain actuator 18 either of two angular positions by snappingly engaging either the indentation 23 or the slot 19 of actuator 18. A cover plate 31, formed with a tongue 32 into cutout 7 and with a keyhole 33, serves as a top end wall closing housing 6 from above. As can be seen from the drawings, particularly FIG. 4, the length of housing 6 is substantially shorter than the transverse dimensions of its two end walls 10, 31, thereby providing a flat, compact construction. Keyhole 33 is designed to admit the hollow shank 36 of a key 34 receivable over stem 9 and having a key bit 37 receivable in slot 19 of actuator 18.

Figure 2:
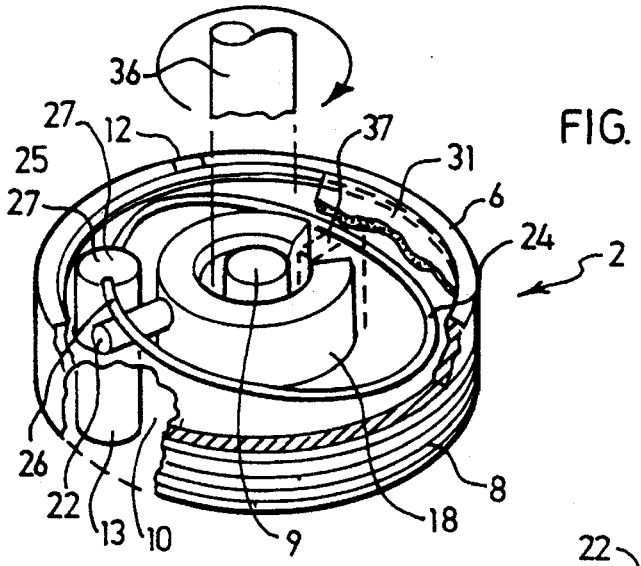
FIG. 2 is a fractional perspective view of the lock of FIG. 1 shown in the unlocked state.

The operation of lock 2 will now be explained with reference to FIGS. 2 and 3.

As shown, finger 22 of actuator 18 is positioned underneath the single turn helical spring 24. When the key 34 is inserted into the keyhole 33, its bit 37 penetrates into slot 19 of the actuator 18 bearing on the two cheeks 20. Turning the key 34 causes actuator 18 to rotate with its finger 22 gliding along the single turn helical spring 24. When the key 34 is turned clockwise all the way until the finger 22 of actuator 18 abuts latch element 27 as shown in FIG. 2, the horizontal end portion 26 of the single turn helical spring 24 is lifted pulling with it latch element 27, which is thereby moved to its retracted position within housing 6.

Figure 3:
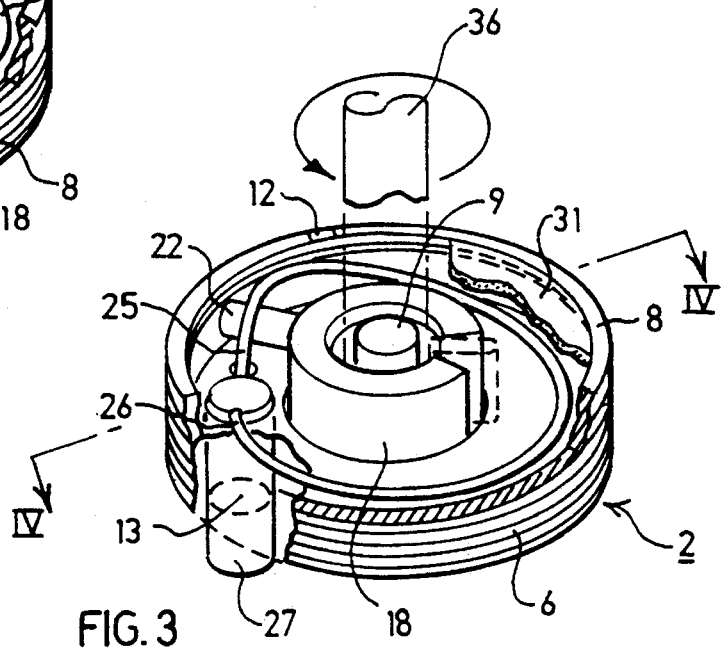
FIG. 3 is a similar view as FIG. 1 showing the lock in the locked state.
Figure 4:
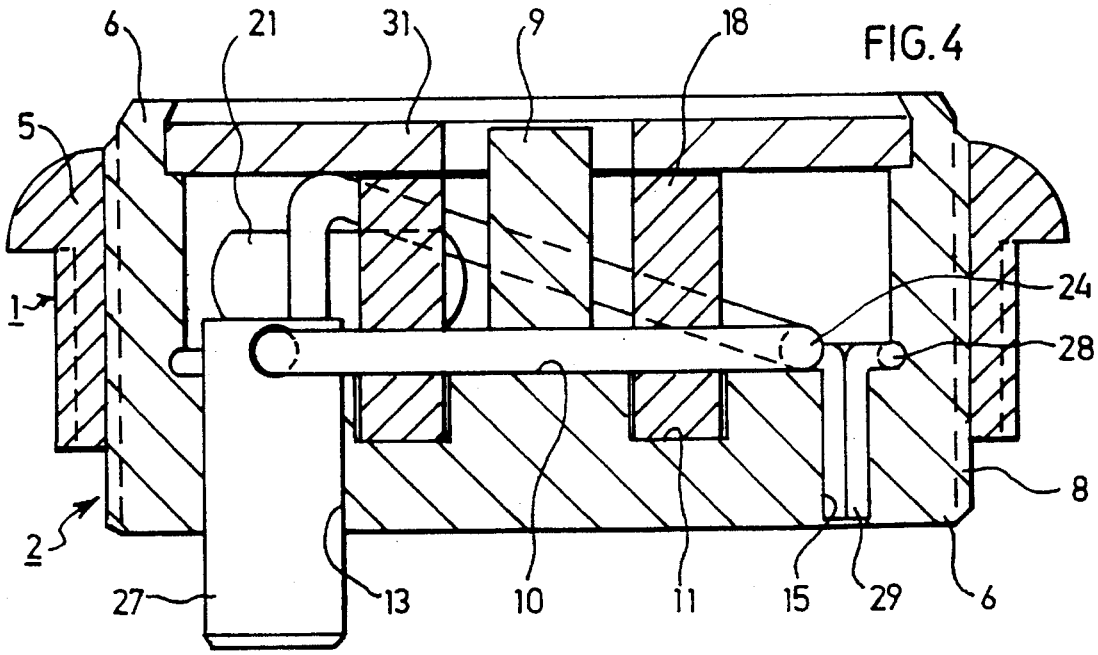
FIG. 4 is a cross-section along line IV—IV in FIG. 3.

When the key 34 is turned all the way anti-clockwise until finger 22 abuts the vertical end portion 25 of the single turn helical spring 24 as shown in FIG. 3, the end portion 26 is urged down, whereby latch element 27 is urged to its projected position through bore 13. If latch element 27 is designed to engage a matching bore or opening, and the bore or opening is out of register with bore 13 so that the latch element encounters an obstacle, it will remain retracted until the matching bore or opening is brought into register with bore 13.

Pre-adjusting the lock, so that the latch element 27 projects in register with the opening of the essential operative component, is carried out by angularly displacing the lock 2 within the sleeve 1 until the latch element 27 eccentically projecting from the lock comes into register with the opening. The angular position of the lock may then be fixed by slightly indenting rim 5 into recess 12 of the housing 6.

Obviously, the lock may be provided with a ward or other means for making it more sophisticated and untamperable, and the key be shaped accordingly, all as known per se.

FIGS. 5–10 of the drawings illustrate how the present invention may be applied to different kinds of firearms. For the sake of clarity and simplicity of illustration, those parts of the weapons illustrated which are known per se and not relevant to the present invention are not shown.

Figure 5:
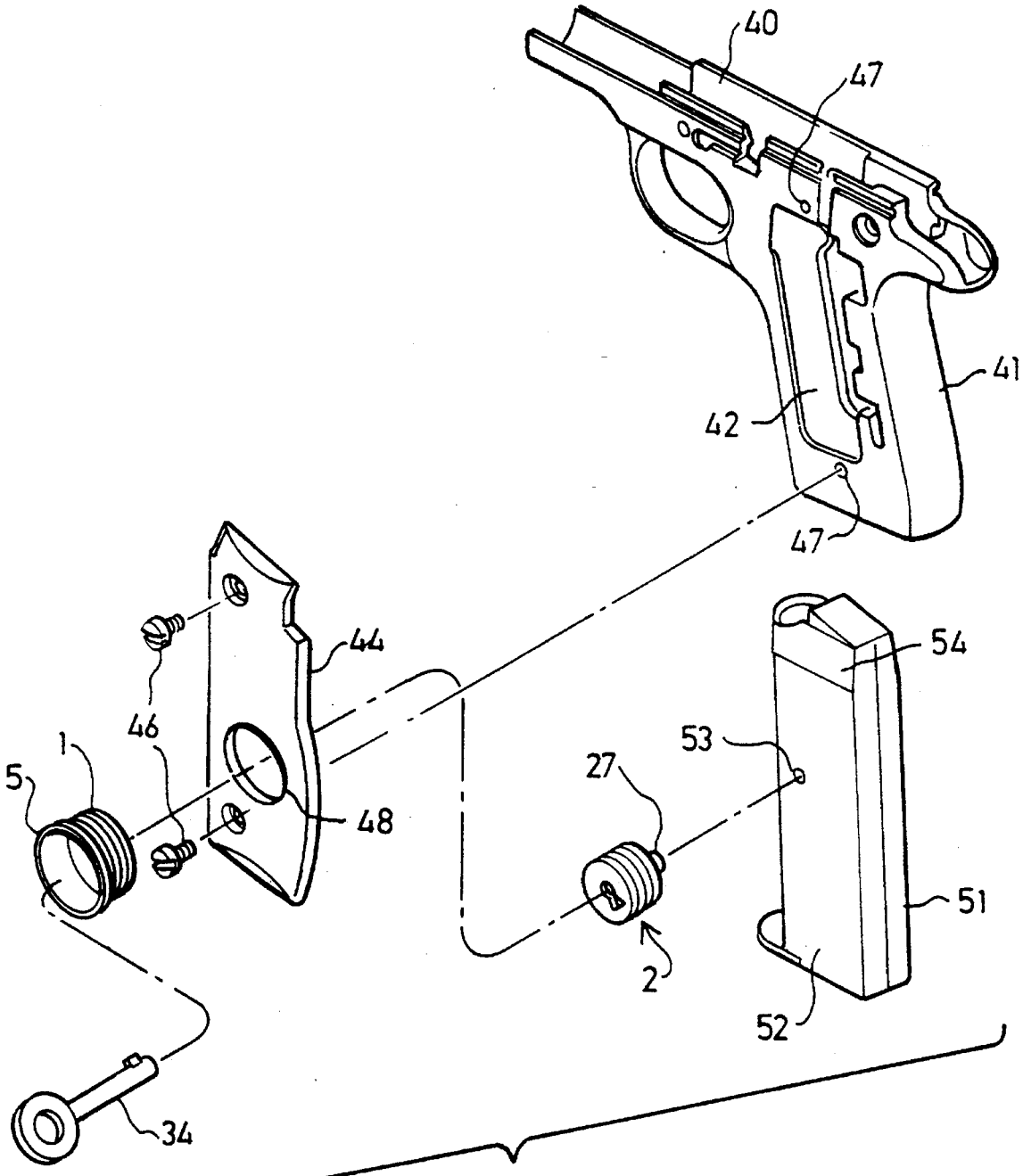
FIG. 5 is an exploded perspective view of an automatic pistol equipped with the lock of FIGS. 1–4.

In FIG. 5 there is shown an automatic pistol having a frame 40 with a grip 41 holding a magazine chamber 42 and fitted with a pair of removable sidewalls 44 (only one of which is shown) attached by screws 46 engaging suitably threaded holes 47 in the frame. The sidewall 44 has a circular cutout 48 which securely holds the sleeve 1 with the rim 5 bearing against the external surface of the sidewall 44. The housing 6 of lock 2 is screwed into the sleeve 1.

A magazine 51 has, on its sidewall 52 facing the removable sidewall 44 of grip 41, an opening 53 for engagement by latch element 27.

When required, lock 2 is locked by means of key 34 whereby the latch element 27 is urged to project into the magazine chamber 42. This operation may be performed either with the magazine 51 present in the magazine chamber 42, or with an empty magazine chamber.

If the locking operation is performed with a magazine fully inserted in the magazine chamber 42, latch element 27 bears on the magazine's sidewall 52; therefore, the magazine must then be partially withdrawn until opening 53 comes into register with latch element 27, whereupon the latch element spontaneously snaps into opening 53; this would arrest the magazine in an intermediate, inoperative position.

If, on the other hand, the locking operation is carried out while the magazine chamber 42 is empty, then upon locking, latch element 27 projects into the magazine chamber 42; upon insertion of a magazine, the latch element 27 glides over the sloping lips 54 of the magazine and snaps into hole 53 as soon as the latter registers with the latch element, again arresting the magazine in an intermediate, inoperative position.

It is an advantage of this locking arrangement that in addition to the pistol becoming inoperative, the cartridges within the arrested magazines are out of reach for as long as the pistol remains locked.

Figure 6:
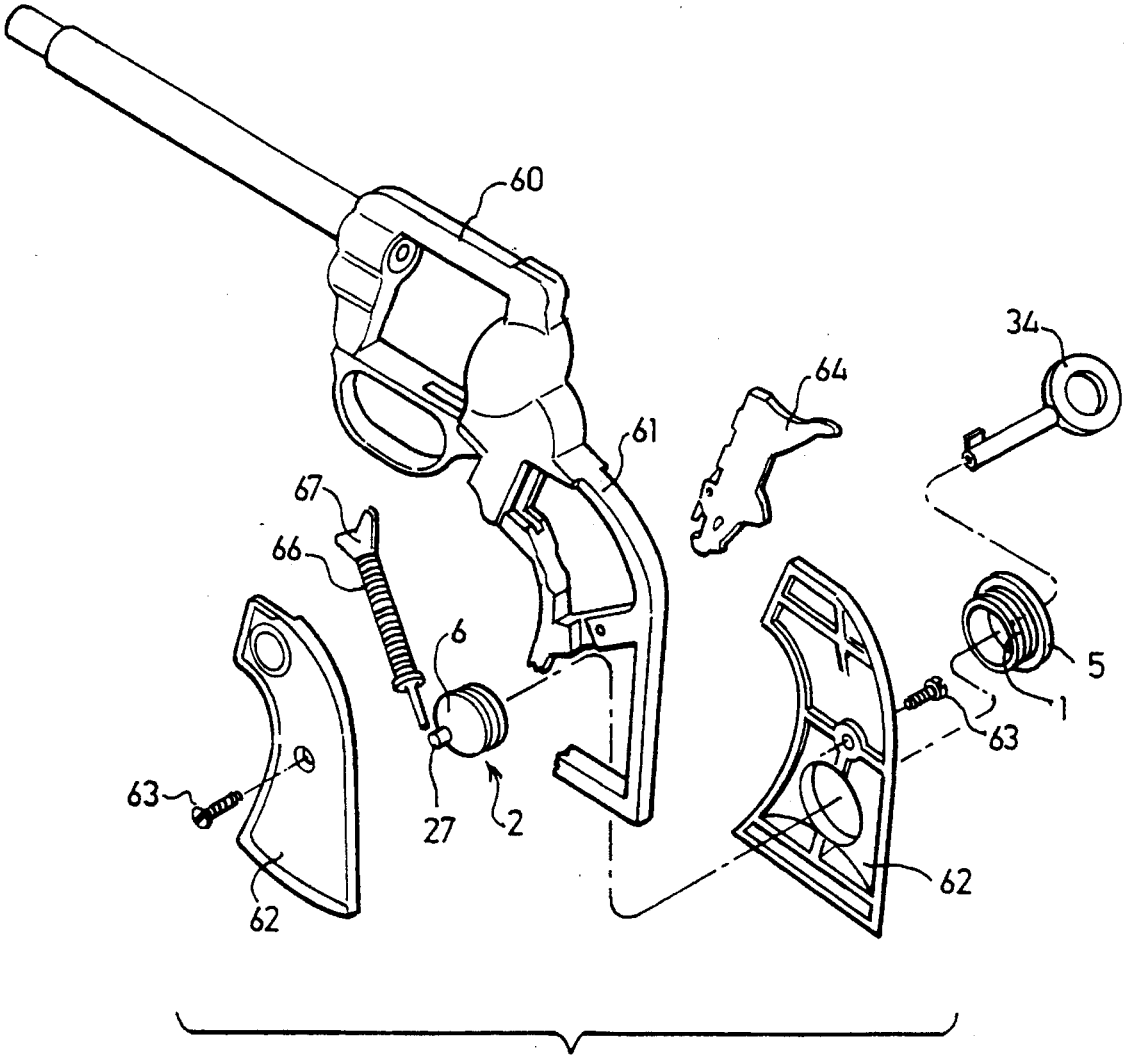
FIGS. 6–8 are exploded perspective views illustrating three types of revolvers, respectively, equipped with the lock of FIGS. 1–4.
Figure 7:
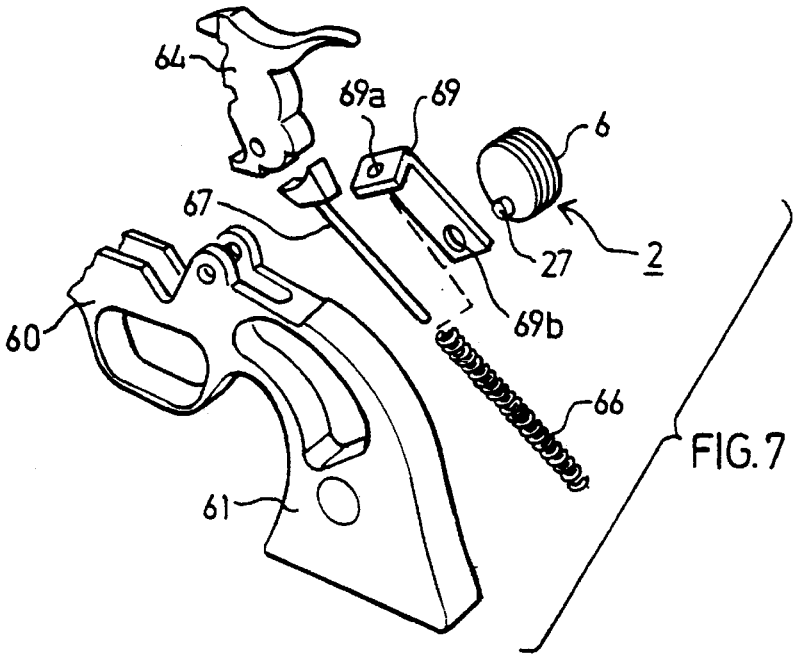
Figure 8:
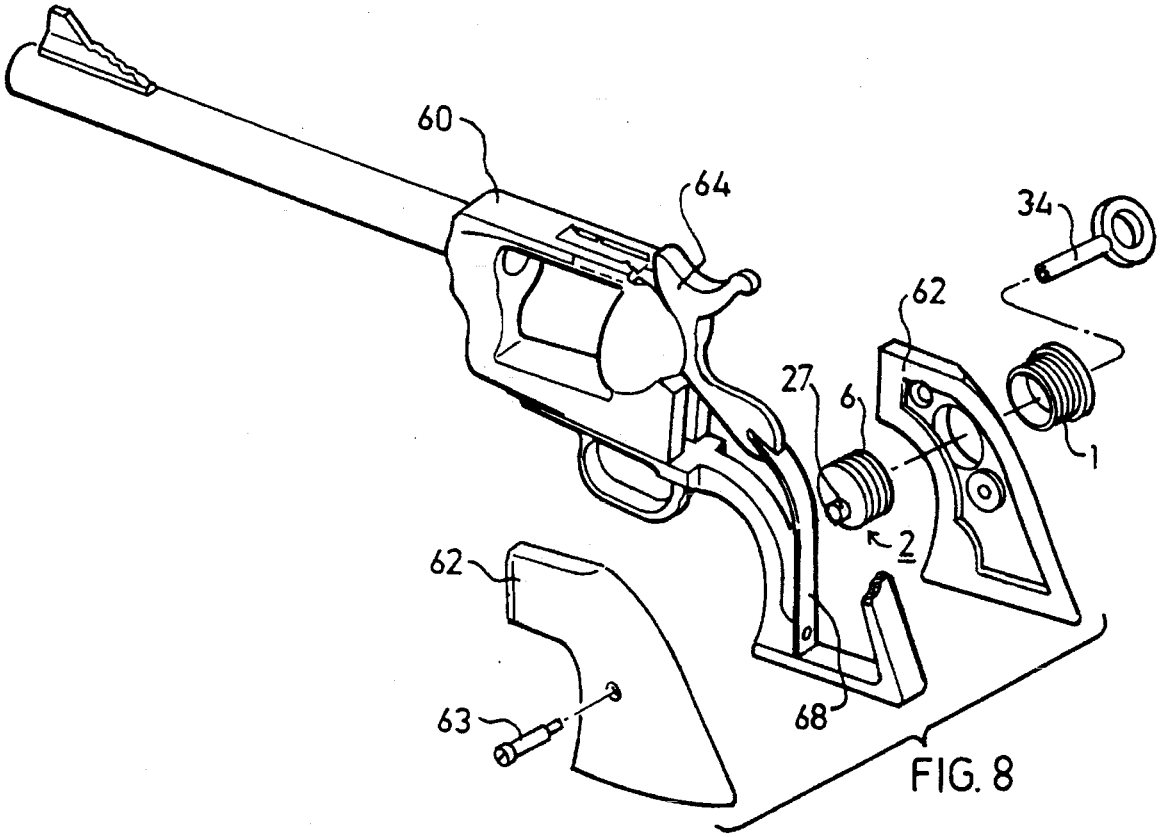

FIGS. 6–8 illustrate how the present invention may be applied to three different kinds of revolvers. To facilitate understanding, those components which are principally the same in these figures are designated by the same reference numerals.

Each revolver includes a revolver frame 60 having a grip 61 and removable sidewalls 62 attached to the grip by screws 63. Each revolver comprises a hammer 64 associated with a main spring which upon actuation propels the hammer to perform a forward striking motion, as known per se. The main spring is either a compression spring 66 mounted on a guiding rod 67 as shown in FIGS. 6 and 7, or a leaf spring 68 as shown in FIG. 8. In all three constructions, upon cocking the hammer 64, the main spring undergoes a deformation whereby it is loaded.

One of the sidewalls 62 is fitted with a lock 2 of the kind shown in FIGS. 1–4 and which functions in a similar manner as explained with respect to the automatic pistol of FIG. 5.

In the embodiment of FIG. 6, the latch element 27 of lock 2 is adapted for engagement with the rear end of the guiding rod 67 whereby, upon locking, latch element 27 prevents the main spring from being tensioned so that the hammer 64 may not be cocked and the revolver cannot be fired.

In the embodiment of FIG. 7, there is an L-shaped bracket 69 having in its foot portion a hole 69*a* whereby the bracket can be slid on the guiding rod 67. A hole 69*b* in the shank of bracket 69 serves for engagement by latch element 27 and upon such engagement the bracket is arrested whereby spring 66 is blocked and cannot be deformed. In consequence the hammer 64 cannot be cocked with the result that the revolver is disabled.

In the embodiment of FIG. 8, the latch element 27 is suited to bear, when in locking position, on the back of leaf spring 68 thereby preventing its deformation whereby the hammer 64 cannot be cocked and the revolver is disabled.

Figure 9:
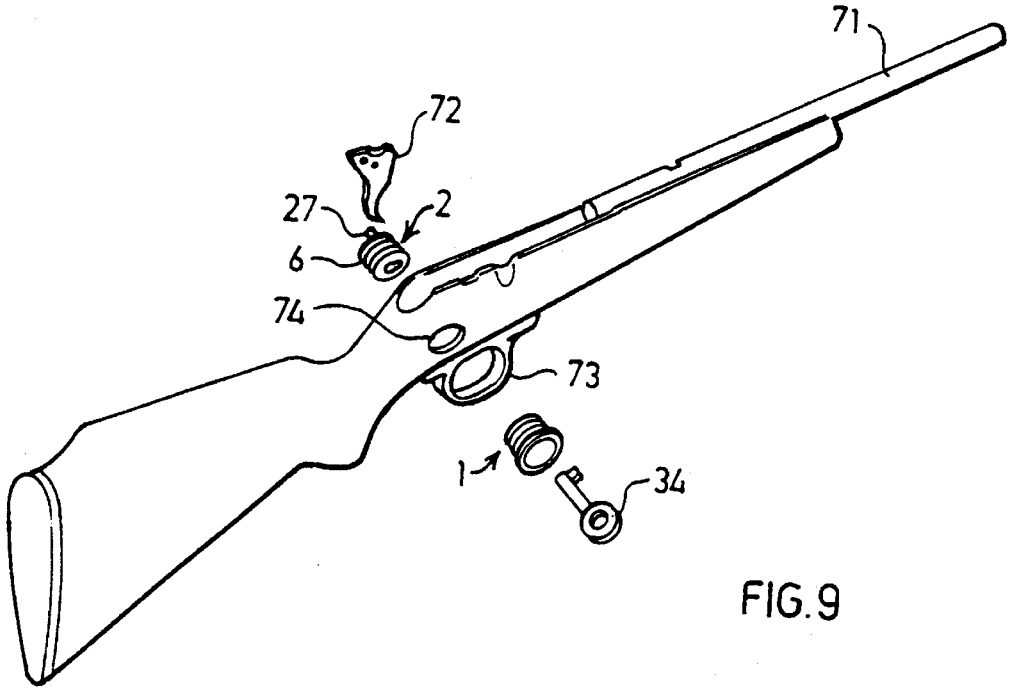
FIG. 9 is an exploded perspective view of a rifle equipped with the lock of FIGS. 1–4.

FIG. 9 illustrates how the invention may be applied to a rifle. A body 70 including a barrel 71 and a firing mechanism, of which only a trigger 72 is shown, has on a sidewall thereon adjacent the trigger guard 73 an opening 74 for accommodating the sleeve 1 holding lock 2. The arrangement is such that in the locking or projecting position of latch element 27, it bears on the rear of the trigger 72, thereby preventing it from being pulled, whereby the rifle is disabled.

Figure 10:
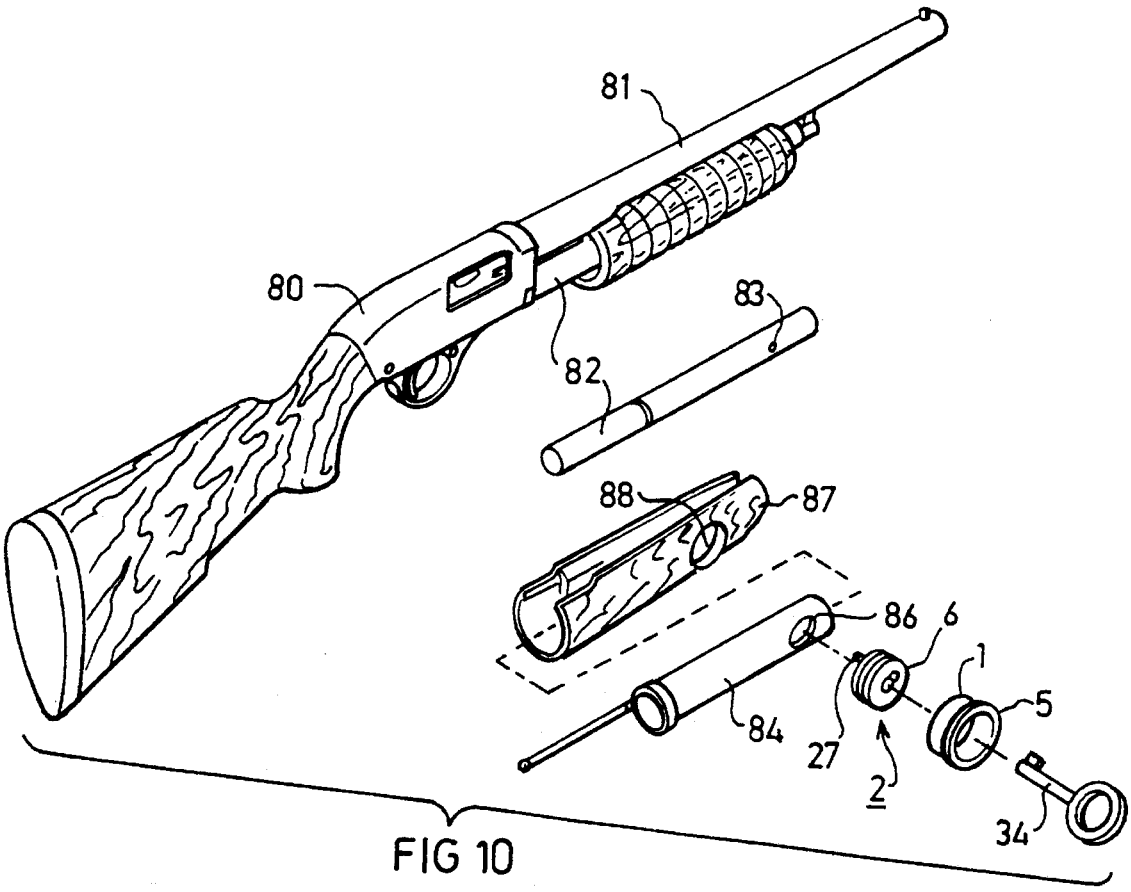
FIG. 10 is an exploded perspective view of a pump action rifle equipped with the lock of FIGS. 1–4.

FIG. 10 illustrates a rifle of the pump-action type comprising a body 80 holding a barrel 81 and a tubular magazine 82 having a lateral hole 83. Enveloping the tubular magazine 82 is a sliding lever 84 reciprocable between a forward position as illustrated in FIG. 10 and a rear portion. Each time the sliding lever 84 is reciprocated, the rifle is cocked and loaded; or alternatively, an empty cartridge is extracted and ejected.

The lever 84 has a hole 86 and is enveloped by a wooden hand guard 87 rigidly attached thereto and having a registering hole 88. Holes 86 and 88 accommodate between them the lock 2. Upon locking, the latch element 27 projects into the hole 83 of the tubular magazine 82 whereby the lever 84 is arrested and the rifle is disabled.

From the foregoing, it is readily understood that the present invention may be applied to different kinds of firearms.

While the invention has been described with respect to one preferred embodiment of lock structure, it will be appreciated that many changes may be made. For example, sleeve 1 may be omitted, and housing 6 applied directly to the firearm. In addition, retainer spring 28 could be omitted or replaced by a springy disc pressing actuator 18 into groove 11 in housing 6 for frictionally loading movement of the actuator. Many other variations, modifications and applications of the invention will be apparent.

What is claimed is:

1. A firearm comprising a plurality of essential operative components the absence or malfunction of any of which renders the firearm inoperative to fire a cartridge;

characterized in that the firearm includes a locking device for receiving a removable key insertable into the locking device, and a latch element movable by an inserted key either to a locking position or to a releasing position;

said locking device including a housing closed at its opposite ends by end walls, the length of the housing being substantially shorter than the transverse dimensions of said end walls;

one of said end walls being formed with a keyhole for receiving said removable key, and the opposite end wall being formed with an opening through which said latch element projects to said locking position when moved by the inserted key;

said housing further including a rotatable actuator having a finger engageable with said latch element;

said actuator being rotatable by the insertion and rotation of a key via said keyhole to rotate the finger to move said latch element to its locking position by projecting said latch element through said opening in the housing, or to its releasing position retracting said latch element within said housing;

and attaching means for attaching said housing to the firearm such that said latch element, when in said locking position, interferes with the operation of one of said essential operative components to disable the firearm from firing a cartridge, and when in said releasing position permits said essential operative component to operate properly and thereby to enable the firearm to be used for firing a cartridge.

2. A firearm comprising a plurality of essential operative components the absence or malfunction of any of which renders the firearm inoperative to fire a cartridge;

said firearm including a locking device for receiving a removable key insertable into the locking device, and a latch element movable by an inserted key either to a locking position or to a releasing position;

said locking device being located such that said latch element, when in said locking position, interferes with the operation of one of said essential operative components to disable the firearm from firing a cartridge, and when in said releasing position permits said essential operative component to operate properly and thereby to enable the firearm to be used for firing a cartridge;

said locking device further comprising a housing formed with a keyhole for receiving said removable key and enclosing said latch element when the latch element is in its releasing position;

said housing further including a rotatable actuator having a finger engageable with said latch element;

said actuator being rotatable by the insertion and rotation of a key via said keyhole to rotate the finger to move said latch element to its locking position by projecting said latch element through said opening in the housing, or to its releasing position retracting said latch element within said housing.

3. The firearm according to claim 2, wherein said key includes a shank, a handle at one end, and a key bit at its opposite end;

said rotatable actuator comprising an opening for receiving said shank, and a slot for receiving said key bit for rotating the actuator;

said finger being engageable with said latch element for moving the latch element to its locking position upon rotation of the actuator in one direction, and to its releasing position upon rotation of the actuator in the opposite direction.

4. The firearm according to claim 3, wherein said housing includes an end wall formed with an annular groove, and said rotatable actuator is of tubular configuration and is rotatably received within said annular groove.

5. The firearm according to claim 4, wherein said housing end wall is further formed with a stem coaxial with said annular groove for receiving the hollow shank of the key.

6. The firearm according to claim 4, wherein said housing end wall is further formed with said opening through which said latch element projects when in said locking position.

7. The firearm according to claim 4, wherein said latch element includes a mounting spring, and said housing end wall is further formed with a second hole for receiving one end of said mounting spring.

8. The firearm according to claim 3, further including a retainer member for retaining the actuator member in either said locking position or releasing position.

9. The firearm according to claim 8, wherein said retainer member comprises a retainer spring receivable in said slot of the actuator in one of said positions, and in an indentation formed in said actuator in the other of said positions.

10. The firearm according to claim 9, wherein said retainer spring is formed with a loop engageable with either said slot or recess in the actuator, said spring being integrally formed with a leg for mounting the retainer spring in another opening formed n said housing.

11. The firearm according to claim 2, wherein said housing is of cylindrical configuration and is formed with external threads, and said firearm includes a cylindrical cavity formed with internal threads for threadedly receiving said housing.

12. The firearm according to claim 1, wherein said essential operative component interfered with by said latch element is a cartridge magazine to be properly positioned in a magazine chamber in said firearm to enable the firearm to be used for firing a cartridge; said latch element, when in its locking position, preventing the proper positioning of the cartridge magazine in said magazine chamber and thereby disabling the firearm from firing a cartridge.

13. The firearm according to claim 12, wherein the firearm is an automatic pistol and includes said magazine chamber in its handle.

14. The firearm according to claim 1, wherein said essential operative component interfered with by said latch element is a hammer to be driven by a main spring to actuate the firing mechanism of the firearm; said latching element, when in its locking position, preventing the operation of the hammer by said main spring, and thereby disabling the firearm from firing a cartridge.

15. The firearm according to claim 14, wherein the firearm is a revolver.

16. The firearm according to claim 1, wherein said essential operative component interfered with by said latch element is a trigger to be actuated by the user's finger to actuate the firing mechanism of the firearm, said latch element, when in its locking position, preventing the actuation of the trigger and thereby disabling the firearm from firing a cartridge.

17. The firearm according to claim 16, wherein the firearm is a rifle.

18. The firearm according to claim 1, wherein said essential operative component interfered with by said latch element is a sliding lever to be reciprocated in order to cock the firearm, said latch element, when in its locking position, preventing the movement of said sliding lever and thereby disabling the firearm from firing a cartridge.

19. The firearm according to claim 18, wherein the firearm is a pump-action rifle.

* * * * *